United States Patent [19]

Higgs

[11] Patent Number: 4,675,953

[45] Date of Patent: Jun. 30, 1987

[54] MONEY CLIP

[76] Inventor: James R. Higgs, 203 Mayne Trace, Waverly, Tenn. 37185

[21] Appl. No.: 792,040

[22] Filed: Oct. 28, 1985

[51] Int. Cl.[4] ..... A44B 21/00

[52] U.S. Cl. ..... 24/499; 24/67.3

[58] Field of Search ..... 40/23 R, 23 A; 150/137; 24/499, 500, 517, 518, 489, 505, 67 R, 67.3, 67.5, 67.7

[56] References Cited

U.S. PATENT DOCUMENTS

| | | | |
|---|---|---|---|
| D. 105,489 | 8/1937 | Lampl . | |
| D. 138,985 | 10/1944 | Ornsteen . | |
| D. 175,981 | 11/1955 | Rubeck . | |
| 362,461 | 5/1887 | Prahar | 24/518 X |
| 396,505 | 1/1889 | Nolan | 24/67.3 |
| 979,806 | 12/1910 | Snyder | 150/137 X |
| 984,162 | 2/1911 | Scott | 24/489 X |
| 1,514,440 | 11/1924 | Cram | 24/499 |
| 1,916,540 | 7/1933 | Strahm . | |
| 2,024,634 | 12/1935 | Feltgen . | |
| 2,526,394 | 10/1950 | Neyer . | |
| 2,628,399 | 2/1953 | Gore | 24/499 X |
| 2,841,853 | 7/1958 | Guyot | 24/499 |
| 2,847,743 | 8/1958 | Voss . | |
| 2,955,337 | 10/1960 | Voss . | |
| 3,456,307 | 7/1969 | Love | 24/499 |
| 4,056,139 | 11/1977 | Murt . | |

FOREIGN PATENT DOCUMENTS

| | | | |
|---|---|---|---|
| 1150631 | 1/1958 | France | 24/67.7 |
| 475933 | 11/1937 | United Kingdom | 24/517 |

*Primary Examiner*—Kenneth J. Dorner
*Assistant Examiner*—James R. Brittain
*Attorney, Agent, or Firm*—Harrington A. Lackey

[57] ABSTRACT

A money clip, including a base clip member and an operative clip member in which the operative clip member has a pair of legs terminating in opposed journals pivotally mounted in bearings to provide offset parallel pivotal axes for the operative clip member. The operative clip member is adapted to move through an over-center position between a closed, clamping position and an inoperative, open position.

7 Claims, 5 Drawing Figures

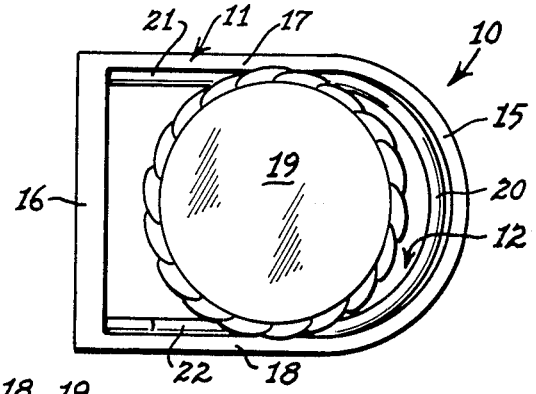
Fig. 1
Fig. 3
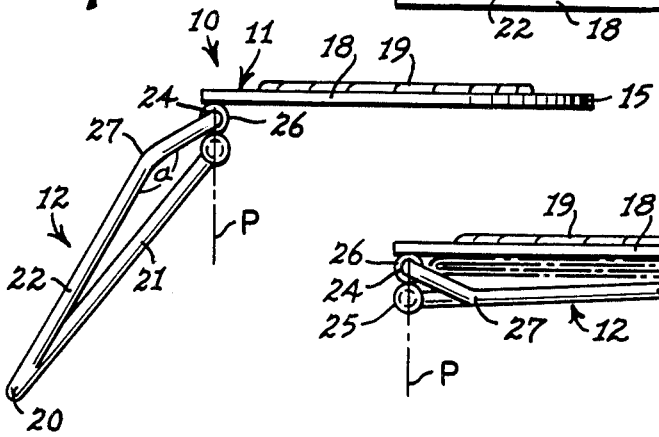
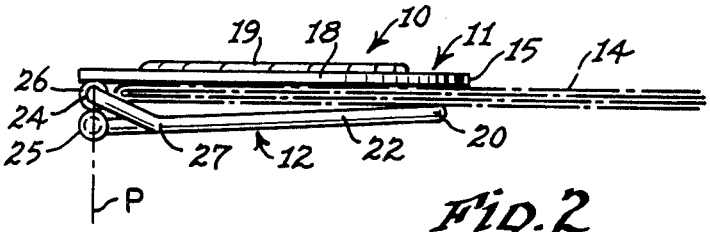
Fig. 2
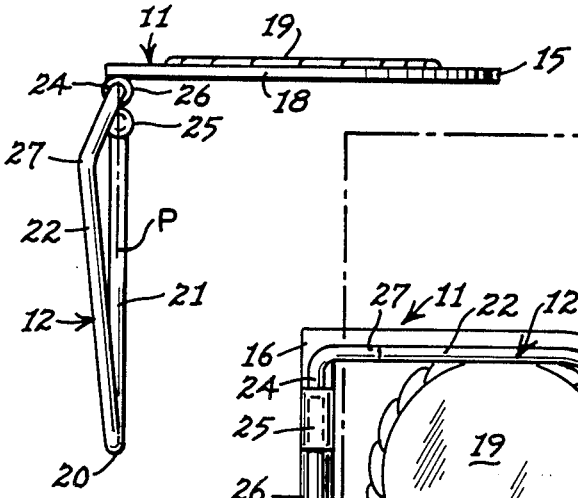
Fig. 4
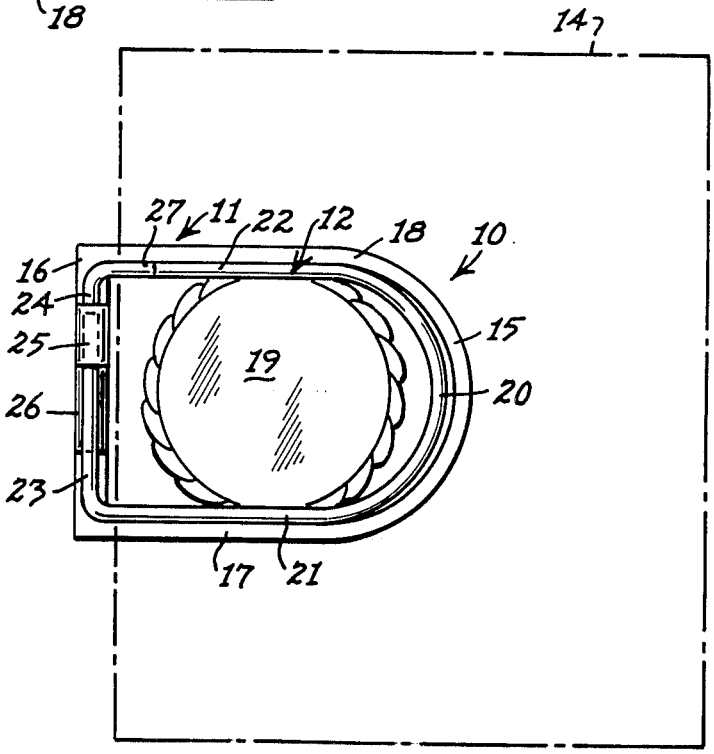
Fig. 5

MONEY CLIP

BACKGROUND OF THE INVENTION

This invention related to a clip, and more particular to a money clip having a pair of hinged clip members.

Money clips of various types are known in the art, such as those disclosed in the following U.S. patents:

| | | |
|---|---|---|
| 2,847,743 | Voss | Aug. 19, 1958 |
| 2,955,337 | Voss | Oct. 11, 1960 |
| 4,056,139 | Murt | Nov. 1, 1977 |
| Des 105,489 | Lampl | Aug. 3, 1937 |
| Des 138,985 | Ornsteen | Oct. 3, 1944 |
| Des 175,981 | Rubeck | Nov. 1, 1955 |

Some of the above patents disclose money clips in which the clip members or clamp jaws are hinged to each other, and others disclose money clips in which the clip members or jaws are integral, but have elastic jaws biased toward each other.

Clasps, such as garment clasps, having opposed hinged jaws connected by toggle-type links are disclosed in the following U.S. patents:

| | | |
|---|---|---|
| 1,916,540 | Strahm | Jul. 4, 1933 |
| 2,024,634 | Feltgen | Dec. 17, 1935 |
| 2,526,394 | Neyer | Oct. 17, 1950 |

However, none of the above patents disclose a money clip having an operative clip member hinged to a base clip member at one end by a pair of parallel journals rotably mounted within corresponding bearings in such a manner that the operative clip member swings through an over-center position relative to the bearings between a retained closed position against the base clip member and a retained open position away from the base member.

SUMMARY OF THE INVENTION

It is therefore an object of this invention to provide a money clip having a pair of clip members in which one clip member swings relative to the other clip member through an over-center position between a retained closed position and a retained open position, without an external spring.

The money clip made in accordance with this invention includes a base clip member having a hinged end portion and a clamp end portion, and an operative clip member pivotally mounted to the hinged end portion and having a clamp jaw adapted to be biased into engagement with the clamp end portion of the base clip member.

The money clip of this invention is further characterized by an operative clip member having a pair of legs projecting generally in the same direction from a clamp jaw at one end portion of the operative clip member, the legs terminating in a pair of opposed, staggered, but parallel journals pivotally received within corresponding bearings fixed parallel to each other upon the base clip member. The bearings are so disposed that the semi-elastic legs of the operative clip member flex and cross through an over-center plane substantially containing the plane of the parallel bearings. Thus, when the operative clip member is either in its closed position, clamping money between the clip members, or in an open position, the operative clip member will be retained in either of these two extreme positions.

BRIEF DESCRIPTION OF THE DRAWING

FIG. 1 is a top plan view of the money clip made in accordance with this invention;

FIG. 2 is a side elevation of the money clip disclosed in FIG. 1 in a closed position clamping currency;

FIG. 3 is a side elevation of the money clip disclosed in FIG. 2 in an open position;

FIG. 4 is a side elevation of the money clip in an intermediate, substantially over-center position; and FIG. 5 is a bottom plan view of the money clip.

DESCRIPTION OF THE PREFERRED EMBODIMENT

Referring now to the drawing in more detail, the money clip 10 made in accordance with this invention includes a base clip member 11 and an operative clip member 12, adapted to clamp or hold between them, in closed position, sheet material, preferably in the form of folded paper money 14 (FIGS. 2 and 5).

The base clip member 11 is disclosed in the form of a U-shaped metal wire member in which the bight is the clamp end portion 15. A hinged end portion 16 in the form of a transverse bar is fixed across the opposite ends of the legs 17 and 18 of the base clip member 11.

The base clip member 11 may also be provided with a decorative plate member 19, upon which any inscription or decoration may be imposed.

The base clip member 11, as well as the plate member 19, may be generally coplanar, if desired.

The operative clip member 12 may be formed of a U-shaped metal wire member having a slight degree of elasticity. The bight end portion of the operative clip member 12 defines a clamp jaw 20.

The legs or leg portions 21 and 22 of the U-shaped operative clip member 12 extend generally parallel to each other and in the same direction away form the clamp jaw 20 and terminate at their opposite ends in opposed parallel journals or journal pins 23 and 24, respectively. The first journal pin 23 is pivotally received within a first elongated, tubular beating 25. The second journal pin 24 is pivotally received in another elongated tubular bearing 26 which is secured to the first bearing 25 and to the hinged end portion 16 of the base clip member 11, such as by soldering. In a preferred form of the invention, both tubular bearings 25 and 26 are disposed parallel to each other and in a plane which may be substantially normal to the plane of the base clip member 11, as disclosed in FIG. 2.

The leg 22 is bent at an angle a (FIG. 3) to provide a bent portion 27 joined to the journal 24 in order to displace the legs 21 and 22 from the same plane, particularly in the open position. Moreover, as disclosed in FIG. 2, the bent portion 27 permits the major portions of the legs 21 and 22 to lie substantially in the same plane in the closed position to provide a more even and symmetrical grip upon the money. The angle a may vary, and may even be 90°.

In the operation of the money clip 11, the operative clip member 12 is manually swung to its open position disclosed in FIG. 3. Because both legs 21 and 22 are lying on the left side of the plane P containing the tubular bearings 25 and 26, and because of the offset positions of the flexed legs 21 and 22, the clip member 12 is retained in its open position.

The operator of the money clip 10 then places the folded paper money 14, or other article, upon the base clip member 11. The operative clip member is then forced to swing toward its closed position by first swinging through the plane P disclosed in FIG. 4. The legs 21 and 22 swing through their over-center position in which the bent leg 22 begins biasing the short leg 21 toward the closed position of FIG. 2 instead of the open position of FIG. 3. After the legs 21 and 22 have passed through their over-center position, the leg 22, because of its elasticity, then pulls the operative clip member 12 towards the closed position to clamp the paper money 14, as disclosed in FIG. 2.

Thus, the elasticity of the legs 21 and 22, as well as the offset and parallel positions of the pivot points of the hinged ends of the legs 21 and 22, provide an inherent biasing mechanism which automatically retains the operative clip member 12 in either its open position (FIG. 3) or its closed position (FIG. 2). The bent leg 22 functions as a spring which is an integral part of the operative clip member 12.

It is thus apparent that a money clip 10 has been developed of simple construction in which the clip members may be retained in either their closed or open positions by the inherent elasticity and location of the legs of the operative clip member, and without any additional spring mechanism.

What is claimed is:

1. A clip comprising:

(a) a base clip member having a hinged end portion and a clamp end portion, (b) an operative clip member having one end portion comprising a clamp jaw and first and second legs projecting in the same general direction from said clamp jaw, (c) said first leg comprising a substantially planar portion and a bent portion forming an angle with said planar portion for resiliently biasing said first leg and terminating in a first journal, (d) said second leg comprising a substantially planar portion terminating in a second journal, (e) said first and second journals having journal axes transversely offset from each other, (f) a first bearing receiving said first journal for pivotal movement about its journal axis and a second bearing receiving said second journal for pivotal movement about its journal axis, (g) means fixing said first bearing to said hinged end portion of said base clip member and means fixing said second bearing parallel and adjacent said first bearing, (h) said planar portions of said first and second legs lying substantially coplanar when said operative clip member is biased by said bent portion toward engagement with said clamp end portion in a closed position, and said planar portions being non-coplanar when said operative clip member is swung through an over-center position and biased by said bent portion to an open position away from said base clip member.

2. The invention according to claim 1 in which said operative clip member is U-shaped, said clamp jaw comprising the bight portion of said operative clip member.

3. The invention according to claim 2 in which said base clip member is also U-shaped and disposed generally parallel to said U-shaped operative clip member in said closed position.

4. The invention according to claim 2 in which each of said first and second journals are elongated and project toward each other.

5. The invention according to claim 4 in which each of said bearings is elongated and tubular for pivotally receiving said respective elongated journals.

6. The invention according to claim 1 in which said base clip member is generally planar and said bearings are disposed parallel to each other in a plane transverse to and projecting from the hinged end portion of said base clip member.

7. The invention according to claim 6 further comprising a decorative plate member fixed to said base clip member.

* * * * *